United States Patent [19]

Moss

[11] Patent Number: 4,936,606

[45] Date of Patent: Jun. 26, 1990

[54] METHOD FOR LABELING AN ARTICLE FOR IDENTIFICATION AND A LABEL DEVICE THEREFOR

[76] Inventor: James W. Moss, 4423 Burgundy Dr., Louisville, Ky. 40299

[21] Appl. No.: 931,342

[22] Filed: Nov. 17, 1986

[51] Int. Cl.[5] ..... B42D 15/00; B42F 21/00; B44C 1/00; G09F 3/00

[52] U.S. Cl. ..... 283/70; 283/37; 156/67; 40/306

[58] Field of Search ..... 283/70, 81, 37; 40/2 R, 40/21 R, 21 A, 21 B, 124.4, 306, 310, 312, 595, 570; D20/21, 22; 156/67

[56] References Cited

U.S. PATENT DOCUMENTS

| | | | |
|---|---|---|---|
| 814,592 | 3/1906 | Duane | 40/306 |
| 1,532,782 | 4/1925 | Sheppard et al. | 156/67 |
| 3,835,564 | 9/1974 | Gottschalk | 40/306 |
| 4,004,691 | 1/1977 | Wihksne | 40/312 |
| 4,182,789 | 1/1980 | Castelluzzo | 283/37 |
| 4,243,340 | 1/1981 | MacGregor | 40/312 |
| 4,306,367 | 12/1981 | Otto | 40/312 |
| 4,430,816 | 2/1984 | Seton et al. | 40/2 R |
| 4,546,042 | 10/1985 | Quon | 156/67 |
| 4,551,373 | 11/1985 | Conlon | 40/306 |
| 4,648,548 | 3/1987 | Shin | 40/312 |

FOREIGN PATENT DOCUMENTS

| | | | |
|---|---|---|---|
| 82109 | 7/1976 | Japan | 156/67 |

OTHER PUBLICATIONS

Seton Name Plate Corp. Catalog 834A-2 1983-1984 Series pp. A27 and A28.

*Primary Examiner*—Douglas D. Watts

*Assistant Examiner*—Paul M. Heyrana

*Attorney, Agent, or Firm*—Jon C. Winger

[57] ABSTRACT

A label for marking an article for identification and description including a sheet of material such as paper or vinyl. In one embodiment, selected closed peripheral portions of the sheet material are removed from selected areas of the sheet defining identification and descriptive indicia. One surface of the sheet is coated with an adhesive material for attaching the label to a substrate. In another embodiment, at least one closed peripheral cut is made through the sheet defining the external boundry of identification and descriptive indicia. A method for marking an article for identification and description includes removing selected closed peripheral portions of material from selected areas of a sheet of material to define identification and descriptive indicia, adhesively attaching the sheet of material to a surface of the article such that zones of the article surface are exposed in the areas of the removed closed peripheral portions of the sheet material, and covering the entire sheet of material including the exposed zones of the article surface and an area of the article surface beyond the marginal edge of the sheet of material. Another method for making an article for identification and description includes making at least one peripheral cut through a sheet of material in selected portions of the sheet defining the external boundry of identification and descriptive indicia, adhesively attaching the closed peripheral cut out portions of the sheet to a surface of the article, and covering the closed peripheral cut out portions and an area of the article surface beyond the external boundry of the closed peripheral cut out portions.

11 Claims, 2 Drawing Sheets

METHOD FOR LABELING AN ARTICLE FOR IDENTIFICATION AND A LABEL DEVICE THEREFOR

BACKGROUND OF THE INVENTION

Field of the Invention

The present invention relates to devices and methods for labeling articles, and more particularly to a method for marking an article for identification and description, and a labeling device therefor which is tamper resistant and leaves a tell-tale trace when so tampered with.

Description of the Prior Art

Motor vehicle theft is becoming an increasing problem. Often, motor vehicles are stolen and canibilized for their parts which are then sold individually. The problem has become so acute that the U.S. Government has passed legislation requiring various components of vehicles sold in the United States to be permanently marked with vehicle identification numbers so that they can be more readily traced if the motor vehicle is stolen.

The problem is coming up with a device and method for marking motor vehicle components with identification and descriptive indicia which meets a number of requirements. Among these requirements are: it must not add any significant cost to the manufacturer either in material or time required to apply the marks; it must be permanent; it must be tamper resistant; if tampered with, it must leave a tell-tale trace showing that it was tampered; and it must be difficult to counterfeit. Furthermore, from a practical standpoint, it must not distort or blemish the marked article.

Various methods and devices for marking articles are known, but each has a drawback.

For example, it is known to attach an identification plate to an article by rivets. However, rivets distort or blemish the article, and can be relatively easily be removed. Further, after removal, a counterfeit plate can be easily substituted without a trace of the substitution.

By way of further example, identifying marks can be stamped or otherwise embossed in an article. However, such stamping or embossing is time consuming adding cost to the manufacture of the article, and also distorts or blemishes the article.

SUMMARY OF THE INVENTION

The present invention recognizes the drawbacks of heretofore known marking methods and devices, and provides a solution which meets all of the above-mentioned requirements.

More particularly, the present invention provides in one advantageous embodiment, a method for marking an article for identification and description comprising removing selected closed peripheral portions of material from selected areas of a sheet of material to define identification indicia, adhesively attaching the sheet of material in overlaying relationship to a surface of the article; and covering the sheet of material and an area of the article surface beyond the marginal edge of the sheet of material.

The present invention, in another embodiment provides a method for marking an article for identification and description comprising making at least one closed peripheral cut-out portion through a sheet of material in a selected location of the sheet defining the external boundry of identification and description indicia, overlaying the sheet of material on a surface of the article to be marked, adhesively attaching the closed peripheral cut out portions of the sheet to the article surface, and covering the closed peripheral cut out portions and an area of the article surface beyond the marginal edge of the closed peripheral cut out portions.

The present invention also provides a label for marking an article with identification and description indicia comprising a sheet of material having selected closed peripheral portions of the material removed from selected areas of the sheet defining open areas in the sheet, the peripheral edge of the open areas defining identificaiton and descriptive indicia, and adhesive material coating one surface of the sheet.

The present invention further provides a label for marking an article with identification and description indicia comprising a sheet of material with at least one closed peripheral cut out portion through the sheet, the peripheral edge of the cut out portion defining the external boundry of the identification and description indicia, and adhesive material coating one surface of the cut out portions.

BRIEF DESCRIPTION OF THE DRAWINGS

A better understanding of the present invention will be had upon reference to the following description in conjunction with the accompanying drawings wherein like numerals refer to like parts throughout the several views and in which.

DETAILED DESCRIPTION OF THE PREFERRED EMBODIMENT

Figure 1:
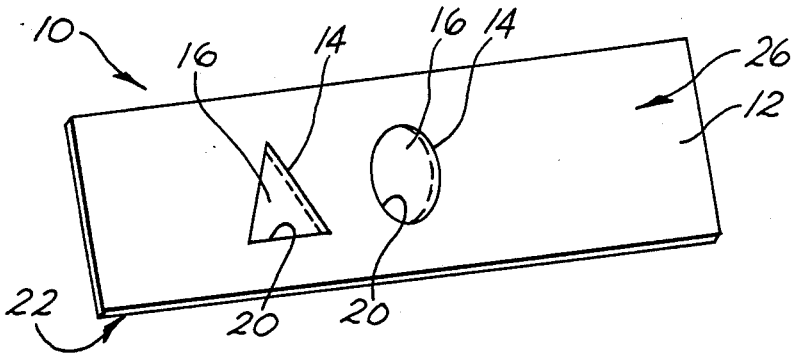
FIG. 1 is a perspective view of one embodiment of a label of the present invention.
Figure 2A:
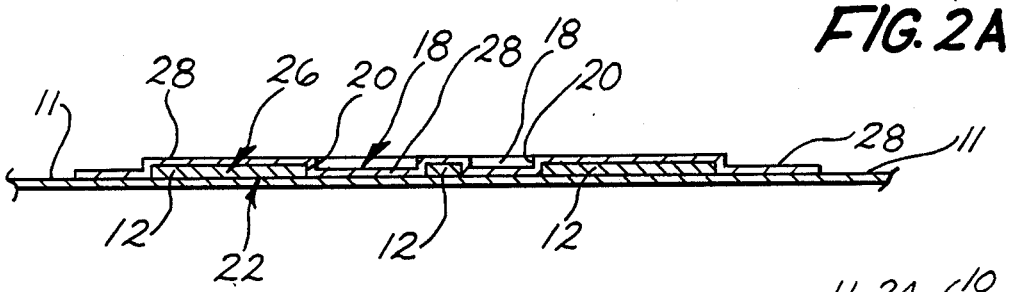
FIG. 2A is a transverse cross-sectional view of the label as seen in the direction of arrows 2A—2A in FIG. 2.
Figure 2:
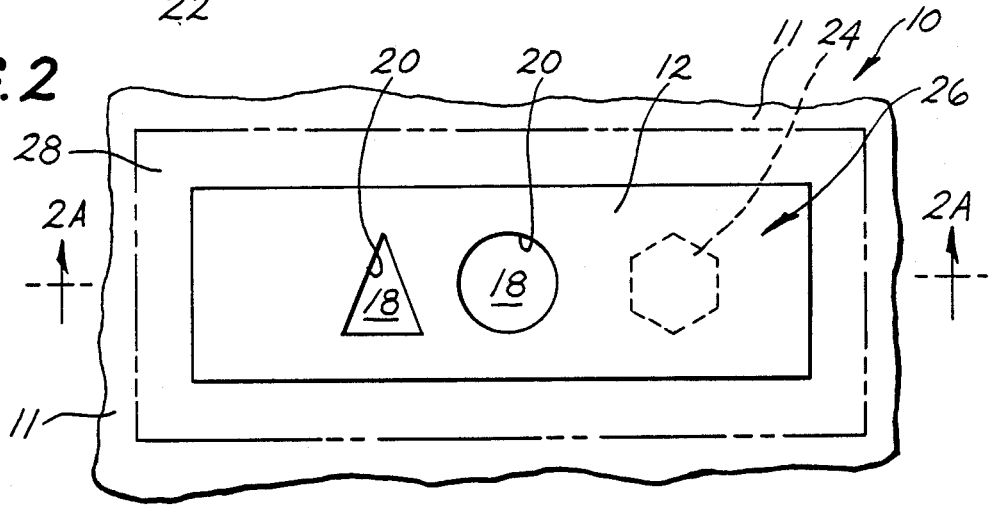
FIG. 2 is a plan view of the label of FIG. 1 applied to an article surface.

With reference to FIGS. 1 and 2, there is shown a label, generally denoted as the numeral 10, for marking an article 11 with identification and description indicia.

The label 10 is shown as including a sheet of flexible material 12. Selected closed peripheral cuts 14 are formed through the sheet 12 in predetermined location of the sheet 12. The closed peripheral cuts 14 define closed peripheral portions 16 which when removed from the sheet 12 leave open areas 18 in the sheet 12. The peripheral edge 20 of each open area 18 defines the identification and description indicia. The indicia can be numerals, letters, a continuation of numerals and letters, a logo, or virtually any shape which may be used to identify, decorate, or describe the article 11.

One surface 22 of the sheet 12 has a coating of adhesive for adhesively attaching the label 10 to a surface of the article 11. In addition, the adhesive material can include a fluorescing material. The fluorescing material would leave a tell-tale trace on the article 11 if the label 10 is removed from the article 11. The tell-tale trace would be invisible under natural light but would be visible under fluorescent light.

In addition, the label 10 can also include printed indicia 24 on the other surface 26 of the sheet 12 from the surface 22 having the adhesive. The indicia 24 is printed on the sheet surface 26 in the locations outside of the closed peripheral portion 16. The printed indicia 24 can be in the form of, for example, a logo. Further, the printed indicia 24 can be printed with a fluorescing ink so that it will be invisible in natural light, but visible under fluorescent light. The printed indicia 24 will function to make counterfeiting of the label 10 very difficult.

The material of the sheet 12 is very thin, for example, a sheet of vinyl or paper. In addition, the material of the sheet 12 can be frangible.

In use of the label 10, the closed peripheral portions 16 are removed from the sheet 12 and the sheet 12 is applied to a surface of the article 11 with the adhesive side 22 of the sheet 12 against the surface of the article 11. Next, a covering, generally denoted as the number 28, is applied over the entire surface 26 of the sheet 12 including the open areas 18 defined by the removed peripheral portions 16 and also over an area of the surface of the article 11 beyond the margin of the sheet 12. The covering 28 can be, for example, an overlay of a thin (0.001 inch) sheet of vinyl having a pressure sensitive adhesive on one side thereof, or a coating of paint or a resin with, or without an included fluorescing material. Because this sheet 12 has a thickness, when it is applied to a surface of the article 11 it projects above the article surface, and when covered with the covering 28 it produces or provides a three dimensional image as can be visualized by reference to FIG. 2A. The continuous covering 28 in the open areas 18 of the sheet 12 covers and adheres to the surface of the article 11 exposed in the open areas 18 and covers and adheres to the surface of the article 11 beyond the margin of the sheet 12. Thusly, the surface of the article 11 in the open areas 18 covered with the covering 28 is recessed or indented from the surface of the sheet 12 covered with the covering 28, and the surface of the article 11 beyond the margin of the sheet 12 covered with the covering 28 is also recessed or indented from the surface of the sheet 12 covered with the covering 28. Therefore, the label 10 produces a three-dimensional image in which the shape of the open areas 18 are visually well defined. The covering 28 protects the label 10 from moisture and makes it very difficult to remove the label 10. The covering 28 also provides a tell-tale trace if the label 10 is tampered with or removed.

Figure 3:
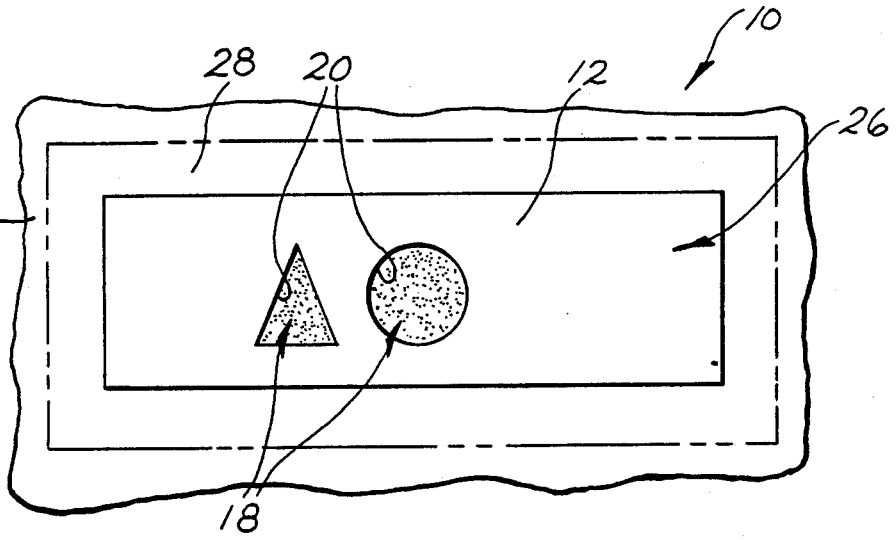
FIG. 3 is a plan view of the label of FIG. 1 applied to an article surface including an additional feature.

With continued reference to FIG. 1 and additional reference to FIG. 3, the areas of the surface of the article 11 exposed by the open areas 18 defined by the removed peripheral portions 16 of the sheet 12 may be etched (as indicated by the mottling in FIG. 3) before the coating 28 is applied. The etching can be accomplished with, for example, acid or sandblasting. Thus, if the label 10 is somehow removed from the surface of the article 11, the indicia will still be evident and difficult to remove from the article surface because the etching would have to be ground away, and the grinding away will cause a distortion in the surface of the article 11.

Figure 4:
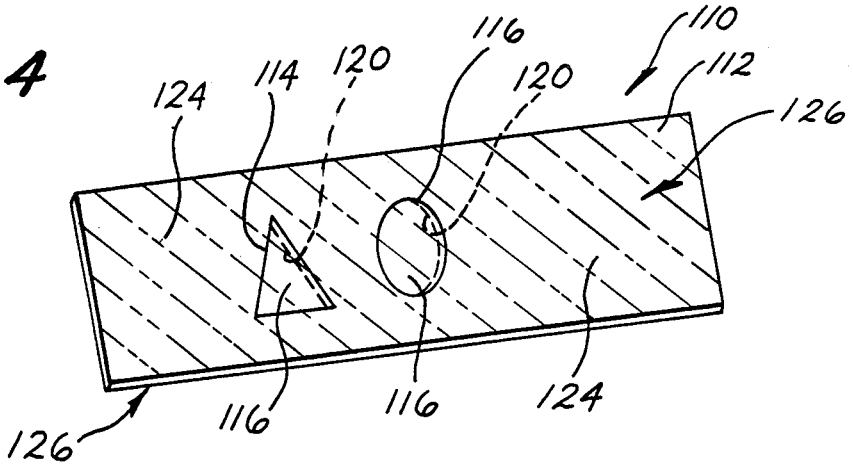
FIG. 4 is a perspective view of another embodiment of a label of the present invention.
Figure 5:
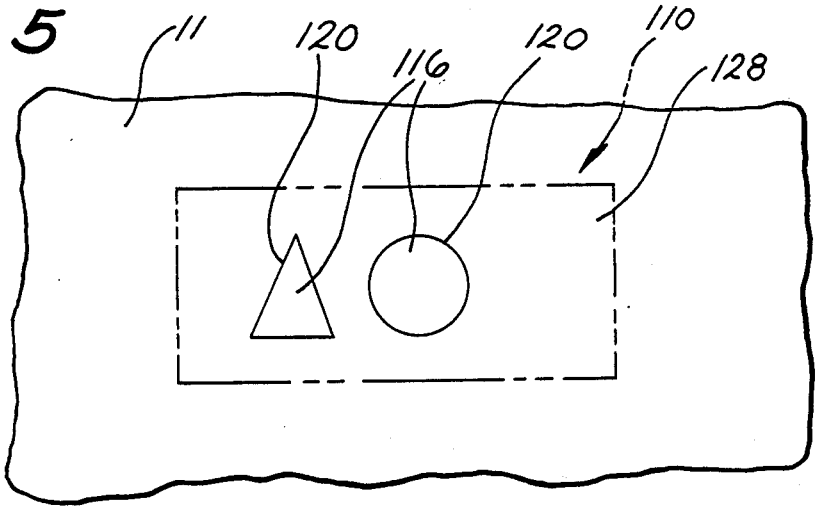
FIG. 5 is a plan view of the label of FIG. 4 applied to an article surface; and, FIG. 6 is a plan view of the label of FIG. 4 applied to an article surface including an additional feature.

Now with reference to FIGS. 4 and 5, there is shown a label, generally denoted as the numeral 110, for marking an article 11 with identification and description indicia.

The label 10 is shown as including a sheet of flexible material 112. Selected closed peripheral cuts 114 are formed through the sheet 112 in predetermined locations of the sheet 112. The closed peripheral cuts 114 define cut out portions 116. The peripheral edge 120 of each cut out portion 116 defines the external boundry of the identification and description indicia. The indicia can be numerals, letters, a combination of numerals and letters, a logo, or virtually any shape which may be used to identify or describe the article 11.

One surface 122 of the sheet 112 has a coating of adhesive for adhesively attaching the cut out portions 116 to a surface of the article 11. In addition, the adhesive material can include a fluorescing material.

In addition, the label 110 can also include printed indicia 124 on the other surface 126 of the sheet 12 from the surface 122 having the adhesive. The indicia 124 can be, for example, in the form of a logo, or as shown, lines which extend across the cut out portions 116. Further, the printed indicia 124 can be printed with a fluorescing ink so that it will be invisible in natural light but visible under fluorescent light.

The material of the sheet 12 is very thin, for example, a sheet of vinyl or paper. In addition, the material of the sheet 112 can be fangible.

In use of the label 110, the sheet 112 is applied to a surface of the article with the adhesive side 122 of the sheet 112 against the surface of the article 11. The sheet 112 is then removed leaving the cut out portions 116 adhesively affixed in place on the surface of the article 11. Next, a covering, generally denoted as the number 128, is applied over the cut out portions 116 and an area of the surface of the article beyond the margins of the cut out portions 116. The covering 128 can be, for example, an overlay of a thin (0.001 inch) sheet vinyl having a pressure sensitive adhesive on one side thereof, or a coating of a paint or a resin with or without an included fluorescing material.

Figure 6:
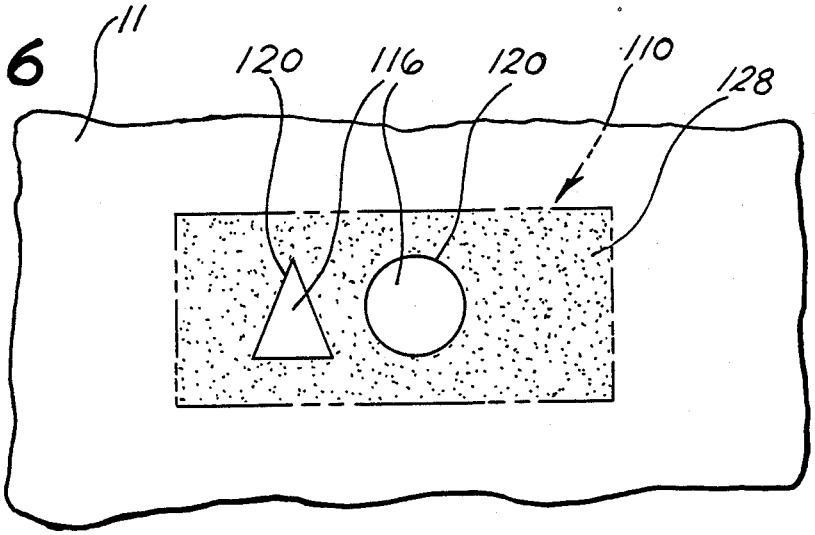

With continued reference to FIG. 4 and addition reference to FIG. 6, the areas of the surface of the article 11 outside or beyond the margins of the cut out portions 116 may be etched (as indicated by the mottling in FIG. 6) before the covering 128 is applied. The etching can be accomplished with, for example, acid or sandblasting.

When the label 10, 110 is applied to a surface of the article 11, it presents a three-dimensional identification and description indicia on the article 11.

The foregoing detailed description is given primarily for clearness of understanding and no unnecessary limitations are to be understood therefrom for modifications will become obvious to those skilled in the art and may be made without departing from the spirit of the invention or scope of the appended claims.

What is claimed is:

1. A method of labeling an article for identification and description comprising the steps of:

removing selected closed peripheral portions of material from preselected areas of a sheet of material leaving closed peripheral open areas in the sheet, the peripheral edge of each open area defining identification and description indicia;

adhesively attaching the entire sheet of material over the entire length and breadth of the sheet of material in overlaying relationship to a surface of the article; and, covering the entire sheet of material including the surface of the article exposed in the open areas defined by the removal of the closed peripheral portions, the margin of the sheet of material, and an area of the surface of the article beyond the margin of the sheet of material with a continuous covering material adhering to the entire length and breadth of the sheet of material, the surface of the article exposed in the opoen areas defined by the removal of the closed peripheral portions, and the area of the surface of the article beyond the margin of the sheet of material.

2. The method of claim 1, wherein the step of covering the entire sheet of material including the surface of the article exposed in the open areas, the margin of the sheet of material, and an area of the surface of the article beyond the margin of the sheet of material with a continuous covering material comprises the steps of:

covering the entire sheet of material including the surface of the article exposed in the open areas, the margin of the sheet of material, and an area of the surface of the surface of the article beyond the margin of the sheet of material with a liquid; and, allowing the liquid covering to dry thereby adhering to the sheet of material, the surface of the article exposed in the open areas, and the area of the surface of the article beyond the margin of the sheet of material.

3. The method of claim 1, wherein the step of covering the entire sheet of material including the surface of the article exposed in the open areas, the margin of the sheet of material, and an area of the surface of the article beyond the margin of the sheet of material with a continuous covering material comprises the steps of:

covering the entire sheet of material including the surface of the article exposed in the open areas, the margin of the sheet of material, and an area of the surface of the article beyond the margin of the sheet of material with a liquid including a fluorescing material; and, allowing the liquid covering to dry thereby adhering to the sheet of material, the surface of the article exposed in the open areas, and the area of the surface of the article beyond the margin of the sheet of material.

4. The method of claim 1, further comprising the step of etching those surface areas of the article exposed by the open areas of the sheet defined by the removal of the closed peripheral portions prior to applying the covering material.

5. The method of claim 1, wherein the covering is an overlay of a destructable sheet of vinyl.

6. An article of manufacture comprising:

a sheet of flexible material adhesively attached over its entire length and breadth to the article in overlaying relationship to a surface of the article, the sheet of flexible material having closed peripheral open areas in the sheet, the peripheral edges of each open area defining identification and description indicia; and, a continuous layer of covering material covering the sheet of material, including the surface of the article exposed by the open areas, the peripheral margin of the sheet, and an area of the surface of the article beyond the margin of the sheet of material, the continuous layer of covering material adhering to the entire length and breadth of the sheet of flexible material, the surface of the article exposed in the open areas defined by the closed peripheral open areas in the sheet, and the area of the surface of the article beyond the margin of the sheet of material.

7. The article of claim 6, wherein the sheet of material further comprises indicia printed on the exposed surface of the sheet outside of the closed periphery open areas.

8. The article of claim 7, wherein the printed indicia is printed with a fluorescing material.

9. The article of claim 6, wherein the areas of the article surface exposed by the closed periphery areas are etched.

10. The article of claim 6, wherein the covering material is colored.

11. The article of claim 6, wherein the covering material includes a fluorescing material.

* * * * *